US009818563B2

(12) United States Patent
Nagel

(10) Patent No.: US 9,818,563 B2
(45) Date of Patent: Nov. 14, 2017

(54) SWIVEL ACTUATING PRESSURE SWITCH

(71) Applicant: Donaldson Company, Inc., Bloomington, MN (US)

(72) Inventor: Douglas Jon Nagel, Stout, IA (US)

(73) Assignee: DONALDSON COMPANY, INC., Minneapolis, MN (US)

( * ) Notice: Subject to any disclaimer, the term of this patent is extended or adjusted under 35 U.S.C. 154(b) by 0 days.

(21) Appl. No.: 15/301,289

(22) PCT Filed: Mar. 31, 2015

(86) PCT No.: PCT/US2015/023614
§ 371 (c)(1),
(2) Date: Sep. 30, 2016

(87) PCT Pub. No.: WO2015/153626
PCT Pub. Date: Oct. 8, 2015

(65) Prior Publication Data

US 2017/0025237 A1 Jan. 26, 2017

Related U.S. Application Data

(60) Provisional application No. 61/972,928, filed on Mar. 31, 2014.

(51) Int. Cl.
*H01H 35/38* (2006.01)
*H01H 35/24* (2006.01)
(Continued)

(52) U.S. Cl.
CPC ..... *H01H 35/38* (2013.01); *H01H 35/24* (2013.01); *H01H 35/34* (2013.01); *H01H 13/06* (2013.01);
(Continued)

(58) Field of Classification Search
CPC .... H01H 13/06; H01H 2223/002; H01H 9/04; H01H 13/86; H01H 2009/048;
(Continued)

(56) References Cited

U.S. PATENT DOCUMENTS 1,792,072 A 2/1931 Chryst
2,951,138 A 8/1960 Petrino
(Continued)

FOREIGN PATENT DOCUMENTS

WO WO-2015153626 A1 10/2015
WO WO-2015153626 A9 10/2015

OTHER PUBLICATIONS

International Application Serial No. PCT/US2015/023614, International Preliminary Report on Patentability dated Jul. 5, 2016, 8 pgs.
(Continued)

*Primary Examiner* — Anthony R. Jimenez
*Assistant Examiner* — Ahmed Saeed
(74) *Attorney, Agent, or Firm* — Mueting, Raasch & Gebhardt, P.A.

(57) ABSTRACT

Swivel actuating pressure switching devices and methods are described herein that include a shorting member that translates and rotates into contact with one or more terminals in response to the application of a specified pressure to a piston included in the switch. The rotation of the shorting member with respect to the one or more terminals can be controlled by a receptacle that can include flutes, which guide the rotational movement of the shorting member in response to fluid pressure that causes the translation of the piston.

17 Claims, 9 Drawing Sheets

(51) Int. Cl.
*H01H 35/34* (2006.01)
*H01H 35/26* (2006.01)
*H01H 13/06* (2006.01)

(52) U.S. Cl.
CPC ... *H01H 35/2614* (2013.01); *H01H 2223/002* (2013.01)

(58) Field of Classification Search
CPC ..... H01H 35/242; H01H 35/26; H01H 35/34; H01H 35/2614; H01H 35/2657
USPC ..... 200/82 R, 275, 82 A, 82 J, 302.1, 203.2
See application file for complete search history.

(56) References Cited

U.S. PATENT DOCUMENTS 3,330,925 A 7/1967 Andrew et al.
3,386,410 A 6/1968 Barnes, Jr.
3,419,692 A 12/1968 Palen
3,619,526 A * 11/1971 Riley ..... H01H 35/34 200/286
5,693,926 A 12/1997 Cassidy
5,902,094 A * 5/1999 Hoenisch ..... B08B 3/026 137/540
7,553,177 B2 * 6/2009 Antonini ..... H01R 13/641 439/314
7,621,786 B2 * 11/2009 Yavari ..... H01R 13/424 439/314
7,824,204 B2 * 11/2010 Fujiwara ..... H01R 13/5219 439/311
8,154,391 B1 * 4/2012 Morris ..... H01H 13/023 200/296
8,328,573 B2 * 12/2012 Boucher ..... H01R 13/4532 439/137
2003/0160520 A1 8/2003 Gloden et al.
2011/0073420 A1 3/2011 Nagel

OTHER PUBLICATIONS

International Application Serial No. PCT/US2015/023614, International Search Report dated Jul. 8, 2015, 2 pgs.
International Application Serial No. PCT/US2015/023614, Written Opinion dated Jul. 8, 2015, 6 pgs.

* cited by examiner

SWIVEL ACTUATING PRESSURE SWITCH

RELATED APPLICATIONS

This application is a U.S. National Stage Filing under 35 U.S.C. 371 from International Application No. PCT/US2015/023614, filed on Mar. 31, 2015, and published as WO 2015/153626 A1 on Oct. 8, 2015, which claims priority to U.S. Provisional Patent Application No. 61/972,928, entitled "SWIVEL ACTUATING PRESSURE SWITCH," filed on Mar. 31, 2014, each of which is incorporated herein by reference in its entirety.

TECHNICAL FIELD

Various embodiments described herein relate to apparatus, systems, and methods associated with actuating a pressure sensing switch.

BACKGROUND

Systems incorporating the use of various fluids under pressure are used in a variety of applications such as personal transportation vehicles, commercial shipping vehicles, construction equipment, lawn care equipment, etc. Many of these applications use pressure sensing switches to ensure proper performance and safety of the pressurized fluid systems. Pressure switches can have various characteristics making them more or less suitable for a desired application. Some characteristics affecting the performance of a pressure switch include the switches life cycle capacity, current carrying capacity, corrosion resistance, crash resistance, and the hysteresis of the switch. Improved pressure switch configurations and methods are desired to provide enhanced characteristics to improve the performance, reliability, and safety.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

In the following detailed description of a pressure switch, such as a swivel actuating pressure switch, reference is made to the accompanying drawings that form a part hereof and in which are shown, by way of illustration, specific embodiments in which the swivel actuating pressure switch may be practiced. These embodiments are described in sufficient detail to enable those skilled in the art to practice the invention. Other embodiments may be utilized and structural, logical, and electrical changes may be made.

The swivel actuating pressure switch described herein provides a novel configuration and method for completing or interrupting an electrical circuit in response to the application of a predetermined pressure to the inlet of the switch. Many benefits exist to the various examples of the switch described below. Some of the advantages include, but are not limited to, a switch that includes a modular design that can offer a wide-range of applications. The individual components of the switch can be configurable in a manner such that the same or similar components can be used regardless of the application required. This modular design can reduce the cost and complexity of the switch. Another advantage includes the actuation mechanism of the switch, which allows the switch to transition from a closed to an open circuit state with low hysteresis in response to pressure fluctuations. Further advantages of the actuation mechanism can include terminals, contacts, and other shorting means that can be configured to achieve high current and pressure capacity, long life cycles, resistance to wear and corrosion, and resistance to vibration. The actuation pressure of the switch can be easily adjusted and in some configurations can be adjusted while the switch is in operation (e.g., when pressure is applied to the piston of the switch).

Figure 1:
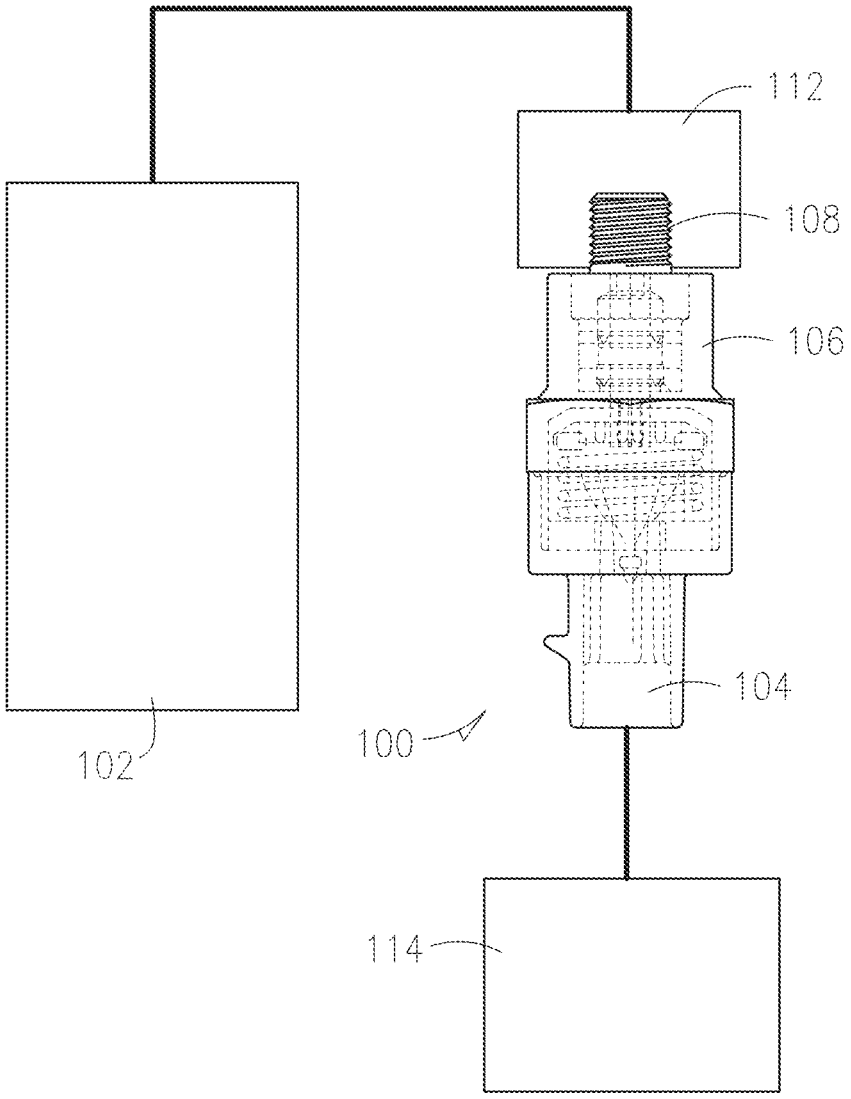
FIG. 1 shows a system incorporating one or more swivel actuating pressure switch devices according to an embodiment of the invention.

FIG. 1 shows a swivel actuating pressure switch 100 incorporated into a fluid pressure system 102 according to an embodiment of the invention. The fluid pressure system 102 may include, but is not limited to a hydraulic system, a pneumatic system, an internal combustion engine, an air brake system, a hydraulic brake system, or other system that includes fluid or gas under pressure. Pressure as described herein can refer to positive pressure, negative pressure, or atmospheric pressure. Likewise, differences in pressure as described can refer to increases or decreases in pressure including changes in pressure from positive to negative and vice versa. The switch 100 can be configured to withstand fluid pressure up to 3500 psi from the fluid pressure system 102.

The pressure switch 100 can connect to a manifold 112. The switch 100 can be sealed to the pressure manifold 112, such as to prevent pressure leakage, such as leakage that can reduce the pressure exposed to at least one inlet of the switch 100. The manifold 112 can be an interface between the pressure switch 100 and the fluid pressure system 102. The manifold 112 can include a first port 108, such as a port that introduces fluid system pressure to an inlet of the switch 100. In some examples, the manifold 112 can have a second port, such as to use the switch 100 to sense a pressure differential between multiple ports (e.g., as shown in more detail in FIG. 8). Additionally or alternatively, the manifold 112 can be configured to include more than two ports.

The fluid pressure system 102 can include at least one fluid. In some examples a fluid can be gasoline, power steering fluid, oil, hydraulic fluid, air, oxygen, hydrogen, nitrogen, biological fluids, or other.

The pressure switch 100 can also be connected to an electrical system 114. In some examples the connection to the electrical system 114 can include a wired connection, a wireless connection, or other form of connection capable of transmitting a signal carried through the switch 100.

Figure 2:
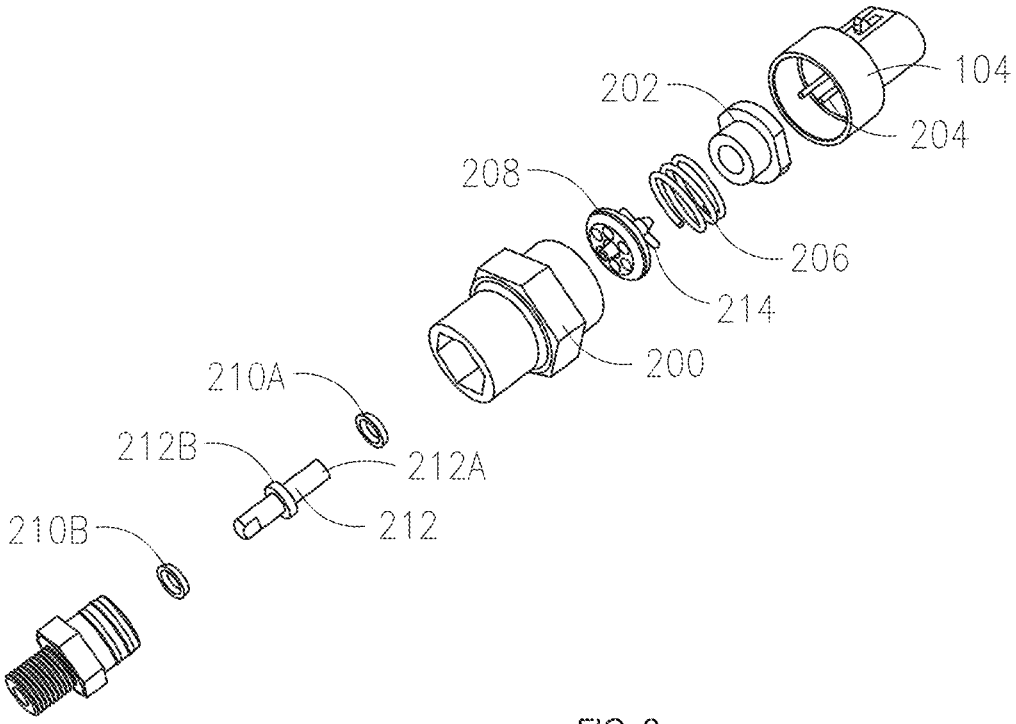
FIG. 2 shows an exploded view of the swivel actuating pressure switch device according to an embodiment of the invention.

FIG. 2 shows an exploded view of the swivel actuating pressure switch 100 according to an embodiment of the invention. The swivel actuating pressure switch 100 can include a connector body 104. The connector body 104 can be configured to capture one or more terminals 204 supported therein. The pressure switch 100 can further include a receptacle 202, a spring 206, a spring plate 208 with a shorting member 214 attached thereto, a housing 106, an O-ring 216, and a piston 212 with one or more u-seals 210A, 210B positioned thereon. A person of ordinary skill in the art will appreciate, after seeing this disclosure, that some features of the switch described below can be integrated with or separated from other features or components to achieve the same function or structure. In an example, the housing 106 can be integrated with the manifold 112 to form a single component; the shorting member 214 and the spring plate 208 could be formed as one piece; or the connector body 104 can be integrated with the connector that mates thereto, such as to form a single component.

Figure 3:
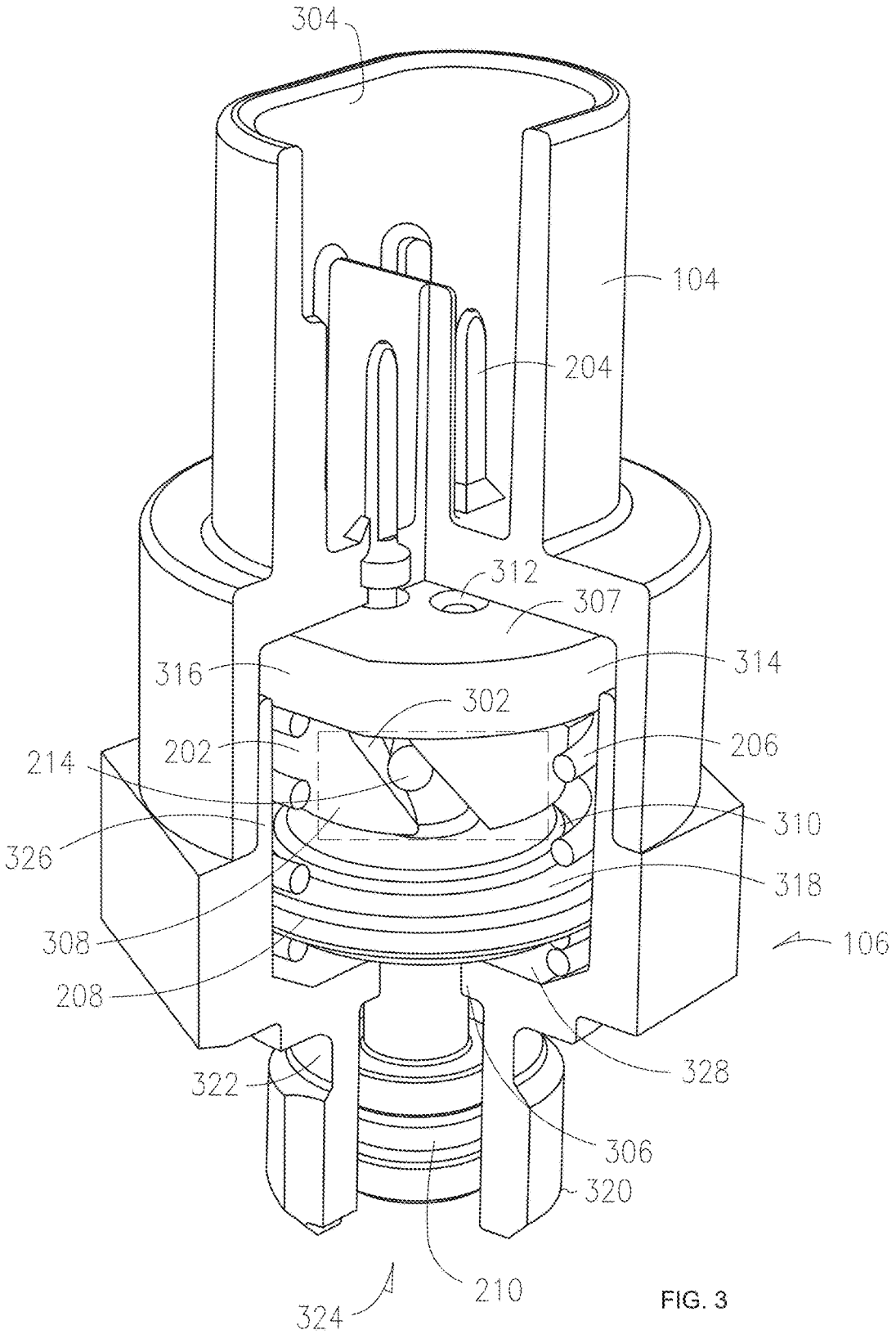
FIG. 3 shows a cross section view of the swivel actuating pressure switch device from FIG. 2, according to an embodiment of the invention.

FIG. 3 shows a cross-section view of the swivel actuating pressure switch 100 according to an embodiment of the invention.

The swivel actuating pressure switch 100 can include a connector body 104. The connector body 104 can include a first end configured as a connector interface 304. The connector interface 304 can engage with one or more electrical connectors for transmitting signals from the pressure switch 100. One of ordinary skill in the art will appreciate, after seeing this disclosure, that connector interface 304 can be configured with any number and combination of connector interface styles, such as non-locking, snap-fit, bayonet, cannon, threaded, or other connection style. In an example, the exterior surface of the connector body 104 can be configured with an engagement feature, such as a snap-fit tab, snap-fit arm, bayonet lug, threads or other engagement features. The connector interface 304 can include one or more terminal configurations, such as in-line, circular, multi-row, or other configuration. In one or more examples, the connector interface 304 can be a sealed connector interface.

The connector body 104 can include at least one terminal 204 supported therein. The one or more terminals 204 can be a pin-type terminal, a socket terminal, a spring contact, a spring loaded pin, or other type of terminal. The ends of the terminal 204 can be rounded, such as to aid in the assembly of the switch 100 or with the mating of a connector. The one or more terminals 204 can be supported within the connector body 104 by any number of means, such as press-fit into a passage in the connector body 104, insert molded into the connector body 104, or glued into the connector body 104. In an example, the one or more terminals 204 can be sealed to the connector body 104. The one or more terminals 204 can be an electrically conductive material, such as copper, phosphor bronze, or stainless steel. The terminal 204 can be plated with an additional material to increase conductivity, reduce wear, improve the corrosion resistance, or provide another benefit. Such plating can include any one of the following materials individually or in combination: nickel, silver, gold, or other material known to improve the characteristics of the electrical terminal 204.

The connector body 104 can include one or more alignment features to key the orientation of the connector interface 104 to a mating connector. The alignment feature can be a rib, slot, groove, or any other type of keying feature on the connector body 104. In an example, the connector body can include a vent. The vent can provide pressure relief, such as to restore the internal pressure of the switch to atmospheric pressure or to provide atmospheric pressure to a piston surface. Additionally or alternatively, the vent can be used as a viewing window, such as for viewing the position of the shorting member 214 with respect to the one or more terminals 204. For sealed versions of the switch 100, the vent can be excluded.

The material of the connector body 104 can be any material capable of handling the pressure and structural requirements of the switch 100. Some examples of the material can include metal or plastic, such as aluminum, zinc alloy, stainless steel, ABS, glass filled polyamide, or other material. In an example, the material of the connector body 104 can be transparent.

A second end of the connector body 104 can include one or more fastening features to fasten the connector body 104 to a housing 106. Some examples of fastening features can include threads, energy directors for ultrasonic welding, channels for adhesive, or other features.

The switch 100 can include a housing 106. A first end of housing 106 can provide an interface to the manifold 112 of the fluid pressure system 102. The interface can include one or more manifold fastening features 320, an O-ring seat 322, or a pressure inlet 324. The manifold fastening features 320 can include one or more means of fastening the switch 100 to the housing 106, such as threads, a snap-fitting, a bayonet lug, or other fastening means. The O-ring seat 322 can be configured on the housing 106 to retain an O-ring on the housing 106 during assembly of the switch 100, during the connection or removal of the switch 100 from the manifold 112, or during the operation of the switch 100. In an example, the O-ring seat 322 can be a groove or channel in the housing 106. The pressure inlet 324 can be a channel positioned on the first housing end. In some examples, the pressure inlet 324 can provide a passage for fluid from the pressure system 102 to come into contact with the piston 212.

A second end of the housing 106 can include one or more fastening features to fasten to the connector body 104. The fastening features can be configured to mate with the fastening features of the connector body 104. Some examples of fastening features can include threads, energy directors for ultrasonic welding, channels for adhesive, or other features. The fastening features can be included on a collar 326 extending from the housing 106. The collar 326 can engage with a similar feature on the connector body 104. In an example, the collar 326 can fit within a similarly shaped and sized feature on the connector body 104, such as to align the connector body 104 with the housing 106. Additionally or alternatively, the internal surface of the collar 326 can include an anti-rotation feature (e.g., a flat surface or other keying feature), such as to prevent the receptacle 202 from rotating within the collar 326.

A pocket 328 can be included in the second housing end. In an example, the pocket 328 can be sized and shaped to receive the spring plate 208, spring 206, and receptacle 202. The pocket 328 can be configured to have a tapered shape, such as to center the spring plate 208. The housing 106 can include a passage 306 extending from the first housing end to the second housing end. The passage 306 can be sized and shaped to guide a piston 212 located therein. The passage 306 can be configured to include one or more diameters, such as to prevent the piston 212 from traveling entirely through the passage 306.

The housing 106 can include manifold fastening features 320 configured to facilitate the fastening of the pressure switch 100 to the manifold 112. In some examples, the manifold fastening features 320 can include a hex lug to be engaged by a socket, a knurled finger grip, or other features to aid in fastening the housing 106 to the manifold 112.

The material of housing 106 can be any material capable of handling the pressure and structural requirements of the switch 100. Some examples of the material can include metal or plastic, such as aluminum, zinc alloy, stainless steel, ABS, glass filled polyamide, or other material. In an example, the housing material can be transparent, such as to allow for inspection of a visual indicator within the switch 100. The visual indicator can be a label or other feature attached to or integrated into the housing 106, such as to provide a visual indication of the shorting member 214 position with respect to the one or more terminals 204 and the receptacle 202.

Although a piston 212 is shown in several examples of switches in the present disclosure, the invention is not so limited. Other actuation configurations, such as a diaphragm, etc. may also be used to actuate a switch.

The piston 212 can be configured to translate within the passage 306, such as when pressure is applied to the first piston end (e.g., the head of the piston). The second piston end can engage or be coupled to the spring plate 208. In one or more examples, the second piston end may include a fastening feature for coupling to the spring plate 208, such as a snap-fit, press-fit, cotter pin, threads, or other fastening feature. In other examples, the second piston end can fit into a pocket located within the spring plate 208. Additionally or alternatively, the interface between the piston 212 and the spring plate 208 can include adhesive. The piston 212 can be various materials. The piston 212 could be cast, molded, or machined from metal, such as aluminum, zinc alloy, stainless steel, or other. The piston 212 can be formed from a plastic material, such as polycarbonate, POM, ABS, glass filled polyamide, or other suitable material. In some examples, the material of the piston 212 can be resistant to oil, gasoline, or other chemical or biological agents than can corrode or degrade the material.

One or more channels can be formed on the surface of the piston 212, such as to retain at least one seal 210 therein. The seal 210 can be a U-seal. The one or more seals 210 can be positioned between the piston 212 and the housing 106. In some examples, two or more seals (e.g. 210A and 210B as shown in FIG. 2) can be included between the piston 212 and the housing 106, such as for failure protection, should one of the seals 210A, 210B fail. The one or more seals 210 can be configured as static or dynamic seals, such as to prevent leakage between the piston 212 and the housing 106 from the fluid system 102. In the example of FIG. 2, seal 210A is configured as a static seal, and does not move with motion of the piston 212. In one example, seal 210B is a dynamic seal, and moves back and forth with movement of the piston 212. In one example, each of the seals 210A, 210B provides a seal for a different diameter portion (212A, 212B) of the piston 212. If one of the seals 210A, 210B fails, the non-failing seal will drive the piston either forward or backward depending on which seal fails. In such an embodiment, system pressure will not be lost due to at least one seal not failing.

In addition, during quality control in manufacturing, if seal 210B fails, a quality control test can pinpoint the failure of seal 210B as a result of the different diameters 212A, 212B that the seals 210A, 210B are sealing. The smaller diameter seal 210A will require more pressure to actuate the switch, thus indicating that seal 210B has failed.

The receptacle 202 extends between a first receptacle end 307 and a second receptacle end 308. The receptacle 202 can be a cylindrical, rectangular, or other geometric shape. The material of the receptacle 202 can be any material capable of handling the pressure and structural requirements of the switch 100, such as aluminum, zinc alloy, stainless steel, ABS, POM, glass filled polyamide, or other material. The receptacle 202 includes a cavity 310 (indicated by the dashed line rectangle) in the first receptacle end 307. The cavity 310 can extend partially through the receptacle 202. The receptacle 202 can include one or more passages 312 extending therethrough, such as a passage 312 from the cavity 310 to the second receptacle end 308. The passage 312 can be configured in a plurality of shapes and sizes. The passage 312 can be round, rectangular, the hemispherical, kidney shaped, or other. The size of the passage 312 can be any size permitting the terminal 204 to extend therethrough. Additionally or alternatively, the cavity 312 can extend though the entire receptacle 202, such as if the passage 312 and the cavity 310 are formed in a single feature.

In one example, additional passages 312 are included in the receptacle to permit the switch to be configured as normally open, or normally closed. This feature is discussed in more detail in FIGS. 5 and 6 below.

A flange 314 can extend outwardly from the receptacle 202, such as from the second receptacle end 308. The flange 310 can be perpendicular to the axis of the cavity 310. In some embodiments, there can be one or more flanges 314 protruding from the receptacle 202. The flange 314 can be sized and shaped, such as to support one end of one or more springs 206. In an embodiment, the flange 314 can include at least one anti-rotation feature 316. The anti-rotation feature 316 can engage the housing 106, such as to prevent the rotation of the receptacle 202 with respect to the housing 106.

The receptacle 202 includes one or more flutes 302 for guiding the shorting member 214, such as one, two, three, four, or other number of flutes 302. The flutes 302 can be formed in one or more configurations, such as slots in the receptacle 202, channels located on the receptacle 202, or ribs located on the receptacle 202. The flutes 302 can extend from the first receptacle end 307 in a direction towards the second receptacle end 308 and transverse to the axis of the cavity 310, such as flutes 302 forming a helical pattern extending from the first receptacle end 307 wrapping around the axis of the cavity 310 in a direction towards a second receptacle end 308. The flutes 302 can be formed in a clockwise configuration or a counter-clockwise configuration.

The first receptacle end 307 can function as a hard stop, such as to prevent the translation of the shorting member 214 beyond a specified location, such as configuring the receptacle 202 and the spring plate 208 to interfere if the shorting member 214 has traveled a maximum desired distance.

The spring plate 208 includes a platform 318 for supporting a second spring end. The platform 318 can be configured with one or more features to center or restrain the movement of the spring 206, such as a channel sized and shaped to receive the second end of the spring 206, such as a column rising into the center of the spring 206, or other feature. The opposite side of the spring plate 208 can be sized and shaped to engage with the housing 106. The spring plate 208 can include a tapered section, such as to center the spring plate 208 in the housing 106. The material of the spring plate 208 can be any material capable of handling the pressure and structural requirements of the switch 100, such as aluminum, zinc alloy, stainless steel, ABS, POM, glass filled polyamide, or other material.

The spring plate 208 can include a shorting member 214. The shorting member 214 can be rigidly attached to the spring plate 208. Alternatively, the shorting member 214 can be rotationally coupled to the spring plate 208. In one or more examples, the spring plate 208 and shorting member 214 can be configured as one or more individual components that are coupled to one another. In some examples the shorting member 214 can be coupled to an elongate stem extending outwardly from the spring plate 208. The shorting member 214 can be coupled to the spring plate 208 by way of an insert mold, snap-fit, interference fit, glue, or other means of attachment. A groove or protrusion can be included on the shorting member 214, such as to aid in the retention of the shorting member 214 within the spring plate 208. The shorting member 214 can be fabricated in part or in whole from electrically conductive material. The shorting member 214 can include a base material that can be covered or plated by the electrically conductive material. Additionally or alternatively, the shorting member 214 can be fabricated entirely from electrically conductive material, such as copper, stainless steel, bronze, beryllium copper, or other contact material. The base material can be plated with nickel, copper, gold, silver or any combination of electrically conductive plating that is suitable for cyclical contact. The base material can be plated with conductive plating that is suitable for corrosion resistance. The shorting member can be configured to have a current capacity, such as one milliamp, 20 milliamps, one-amp, twenty-amps, or sixty-amps.

A spring 206 can be supported between the receptacle 202 and the spring plate 208. The first end of the spring 206 can be supported by the flange 314. The second end of the spring can be supported by the platform 318 of the spring plate 208. Each end of the spring can be configured to engage in a stable manner with a support, such as flange 314 or spring plate 208. In an example, the termination of each spring end can be flat, such as with or without ground ends. A person of ordinary skill in the art will appreciate, after seeing this disclosure, that the spring 206 can be any type of biasing element, such as a coil spring, conical spring, leaf spring, elastomeric body, elastomeric or plastic web, spring fingers, or other type of biasing element. In some embodiments, the material of the spring 206 can be stainless steel, music wire, phosphor bronze, beryllium copper, high carbon steel, spring steel, or other material suitable for spring applications. The compression force of the spring 206 can be configured to a specific application. In an example, the size, shape, and material properties of the spring 206 can be configured to compress a pre-defined length in response to the application of pressure to the piston 212 or spring plate 208 (e.g., switch 100 can have a switch point form 2-350 psi or as low as ½ inch of water). The spring 206 can assist with maintaining a desired orientation (e.g., centered or perpendicular) of the shorting member 214 with respect to the one or more terminals 204, such as by providing uniform pressure around the periphery of the spring plate 208.

The configuration of the switch 100 shown in FIG. 3 can be an example of a crash resistant switch 100. The one or more seals 210 can be positioned within the housing 106, such as to prevent the release of pressure from fluid system 102 in the event that the connector body 104 is damaged or broken from the housing 106.

Figure 4:
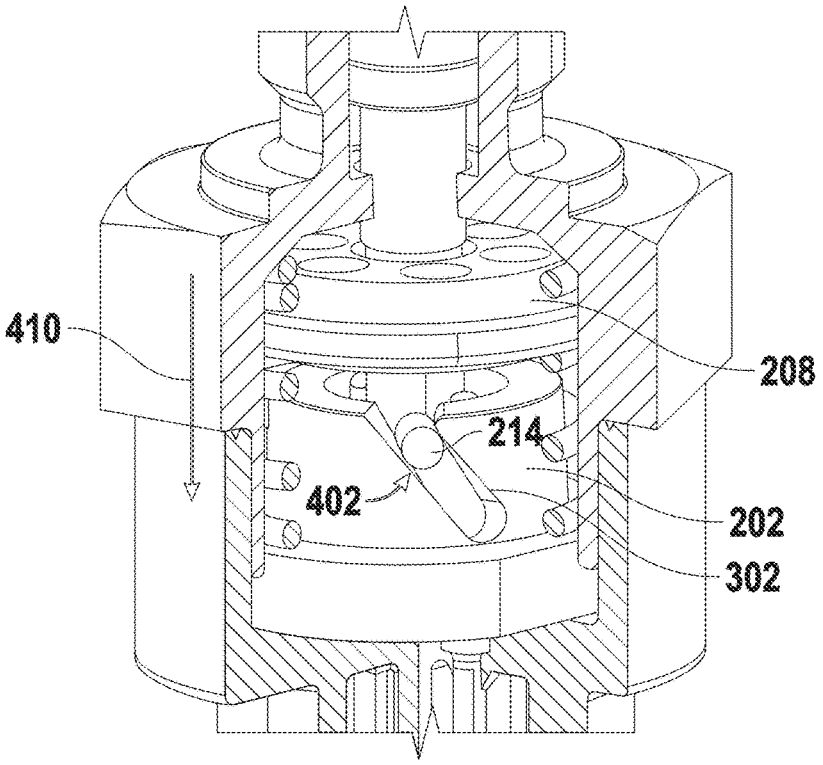
FIG. 4 shows a first location of a shorting member with respect to one or more terminals according to an embodiment of the invention.

FIG. 4 shows the shorting member 214 at a first location 402 with respect to the one or more terminals 204 according to an embodiment of the invention. The shorting member 214 can be maintained in the first location 402, such as by the spring 206 biasing the spring plate 208 in a direction away from the receptacle 202. The receptacle 202, spring 206, and spring plate 208 can be captured within the housing pocket 328, such as by the connector body 104. The spring 206 can be of sufficient length to bias the receptacle 202 against the connector body 104 and the spring plate 208 against the housing 106, such as at the furthest distance from the receptacle 202 within the constraints of the housing pocket 328 and the connector body 104. The shorting member 214 can be engaged within the flutes 302 of the receptacle 202. The flutes 302 can be configured to control the rotation of the shorting member 214 in response to the position of the spring plate 208 with respect to the receptacle 202. The configuration of the flutes 302 can dictate the first location 402 and second location 404 of the shorting member 214 with respect to the one or more terminals 204.

Figure 5:
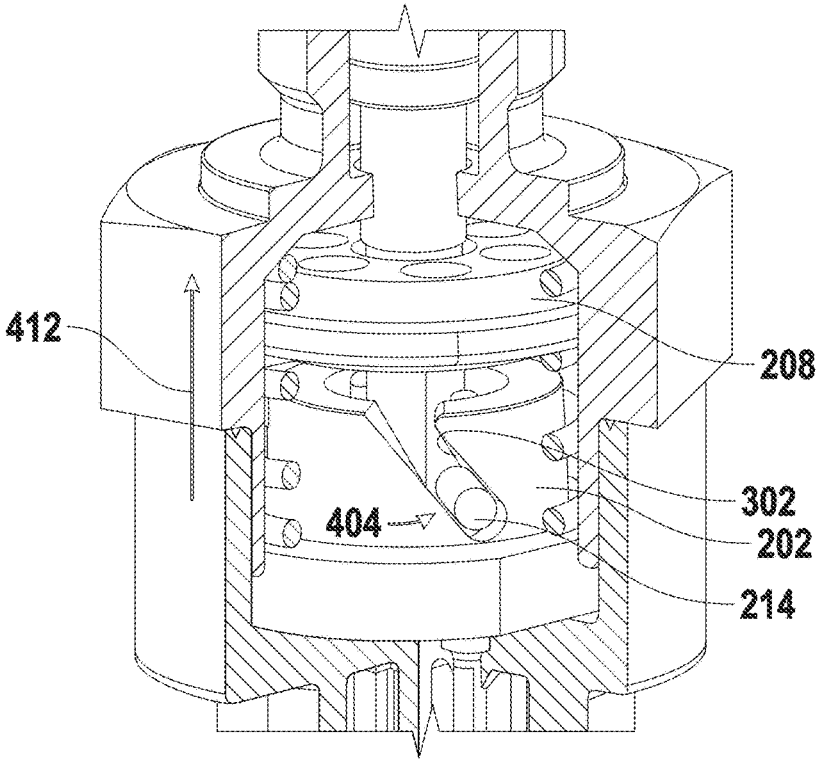
FIG. 5 shows a second location of a shorting member with respect to one or more terminals according to an embodiment of the invention.

FIG. 5 shows the shorting member 214 at a second location 404 with respect to the one or more terminals 204 according to an embodiment of the invention. In some examples, the shorting member 214 can be positioned in a second location 404 with respect to the one or more terminals 204. The shorting member 214 can be positioned in the second location 404 when the spring plate 208 is displaced towards the receptacle 202, such as when spring 206 is compressed and the shorting member 214 is guided to the second location 404 by the flutes 302 of the receptacle 202. The shorting member 214 can translate and rotate with respect to the one or more terminals 204 in response to moving from the first location 402 to the second location 404.

In the example shown in FIGS. 4 and 5, the shorting member 214 moves down in direction 410 in response to increasing pressure, and at the same time is guided by flutes 302 to rotate within the receptacle 202 from location 402 to location 404. In reverse, in response to decreasing pressure, the shorting member 214 moves up in direction 412 and is guided by flutes 302 to rotate within the receptacle 202 from location 404 to location 402.

The switch 100 can be actuated, such as when the shorting member 214 travels from the first location 402 to the second location 404 or when the shorting member 214 travels from the second location 404 to the first location 402. The actuation can occur as a result of the shorting member 214 making contact with the one or more terminals 204. In some examples, the change in pressure required move the shorting member 214 from the first location 402 to the second location 404 and then back from the second location 404 to the first location 402, and vice versa, can occur with low hysteresis, such as 0.10% hysteresis, 1% hysteresis, or 5% hysteresis. The flutes 302 can provide a smooth bearing surface, such as a surface without any transitions in material allowing the shorting member 214 to slide with low friction. Additionally or alternatively, the shorting member 214 and the one or more terminals 204 can undergo low deflection as a result of making contact with one another. The low deflection can reduce fatigue of the shorting member 214 and the one or more terminals 204, such as extending the usable life of the switch 100. The shorting member 214 and the one or more terminals 204 can make contact at a trajectory that reduces the degradation of electrical conductivity, such as a trajectory that creates a sliding or wiping contact between the shorting member 214 and the one or more terminals 204.

The pressure required to actuate the switch 100 can be configurable, such as to increase or decrease the tolerance of the actuation pressure. In some instances it can be desirable to increase the tolerance of the actuation pressure. A higher tolerance can prevent actuation resulting from momentary pressure fluctuations.

In an example, the spring 206 included in the switch 100 can be a multitude of lengths or spring-constants, such as to achieve the desired amount of pressure required to actuate the switch 100. The pressure required to actuate the switch 100 can be 2 PSI, 50 PSI, 100 PSI, or 350 PSI. Additionally or alternatively, the orientation of the receptacle 202 can be configurable with respect to the position of the one or more terminals 204. The further the shorting member 214 must rotate before making contact with the one or more terminals 204, the more translation is required of the piston 212, and thus a greater amount of pressure can be required to compress the spring 206 the necessary amount.

The orientation of the receptacle 202 can be constrained by the housing 106, such as by the collar 326 of the housing 106. By constraining the orientation of the receptacle 202 with respect to the housing 106, the position of the shorting member 214 with respect to the one or more terminals 204, for example in the first location 402 or the second location 404, can be modified, such as by rotating the connector body 104 with respect to the housing 106. The pressure required to actuate the switch 100 can be modified (e.g., calibrated) while the switch is in operation, such as when pressure is applied to the piston 212 or spring plate 208. The one or more passages 312 can be sized and shaped to accommodate the rotation of the receptacle 202 with respect to the at least one terminal 204, such as to prevent interference of one or more terminals 204 with the receptacle 202. The actuation pressure of the switch 100 can be set before or after the connector body 104 is fastened to the housing 106.

In some examples the means of fastening the connector body 104 to the housing 106 can accommodate further adjustment to the actuation pressure of the switch 100. In some examples, the receptacle 202 can be keyed to the connector body 104. In this configuration, the connector body 104, receptacle 202 and shorting member 214 can rotate in unison when the connector body 104 is rotated with respect to the housing 106. The connector body 104 can be fastened to the housing 106, such as by a threading means. The actuation pressure of the switch 100 can be configurable by rotating the connector body 104 with respect to the housing 106, such as by increasing or decreasing the spring compression in response to the translation of the connector body 104 with respect to the housing 106. The translation can result from the treading or un-threading of the connector body 104 from the housing 106. The thread pitch can be configured, such as to allow for micro or macro adjustment of the actuation pressure. Additionally or alternatively, the fastening means can result in a fixed actuation pressure of the switch 100.

In some examples, an electrical circuit can be closed as a result of the shorting member 214 contacting the one or more terminals 204. In other examples, the electrical circuit can be opened as a result of the shorting member 214 loosing contact with the one or more terminals 204. The electrical system 114 can detect whether an open or closed circuit condition exists within switch 100. The one or more terminals 204 can communicate the condition (e.g., open or closed circuit) of the circuit to the electrical system 114 through the connector interface 304.

Figure 6:
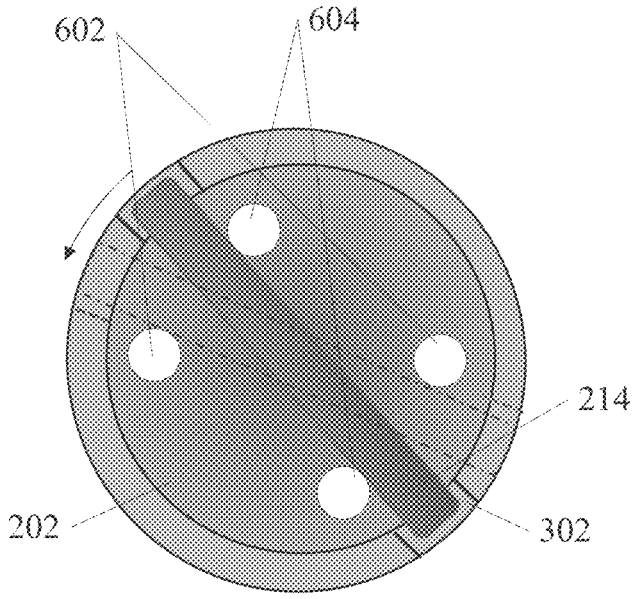
FIG. 6 shows a normally open configuration of the switch according to an embodiment of the invention.

FIG. 6 shows an embodiment of the swivel actuating pressure switch 100, such as a normally open configuration of the switch 100. In the normally open configuration, the switch 100 can be in a non-actuated condition when the shorting member 214 is in the first location 402 with respect to the one or more terminals 204. In an example, the switch 100 can be in an actuated condition when the shorting member 214 is in a second location 404 with respect to the one or more terminals 204. The shorting member 214 can rotate and translated with respect to the one or more terminals 204, such as to make contact with the one or more terminals at the second location 404.

In the normally open example of FIG. 6, passages 602 hold the terminals 204, and passages 604 remain unoccupied. By including a number of passages 602, 604, the receptacle 202 component is flexible, and can be manufactured in a single configuration, yet used in a switch that is either configured as normally open, or normally closed.

Figure 7:
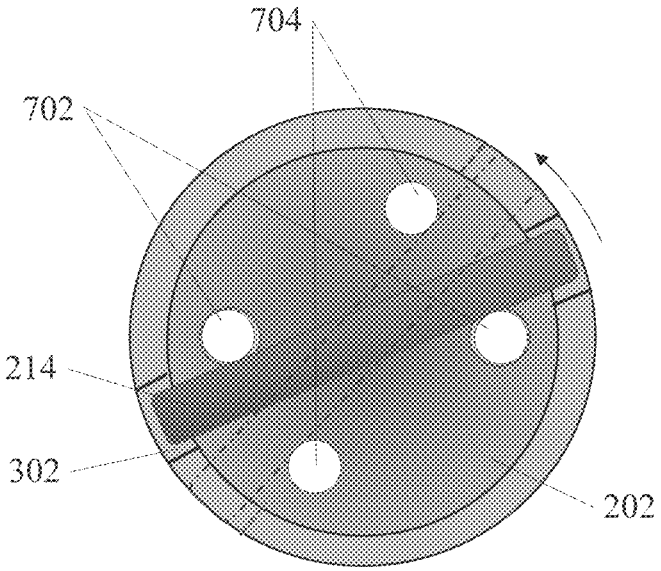
FIG. 7 shows a normally closed configuration of the switch according to an embodiment of the invention.

FIG. 7 shows an embodiment of the swivel actuating pressure switch 100, such as a normally closed configuration of the switch 100. In the normally closed configuration, the switch 100 can be in an actuated condition when the shorting member 214 is in the first location 402 with respect to the one or more terminals 204. In an example, the switch 100 can be in a non-actuated condition when the shorting member 214 is in a second location 404 with respect to the one or more terminals 204. The shorting member 214 can rotate and translated with respect to the one or more terminals 204, such as to break contact with the one or more terminals at the second location 404. The switch 100 can be configurable, such as to modify the switch 100 to operate in the normally open or normally closed configuration. Modifying the switch 100 from a normally open condition to a normally closed condition can be achieved through the rotation of the connector body 104 with respect to the housing 106 as described above.

In the normally closed example of FIG. 7, passages 702 hold the terminals 204, and passages 70 remain unoccupied. By including a number of passages 702, 704, the receptacle 202 component is flexible, and can be manufactured in a single configuration, yet used in a switch that is either configured as normally open, or normally closed.

Figure 8:
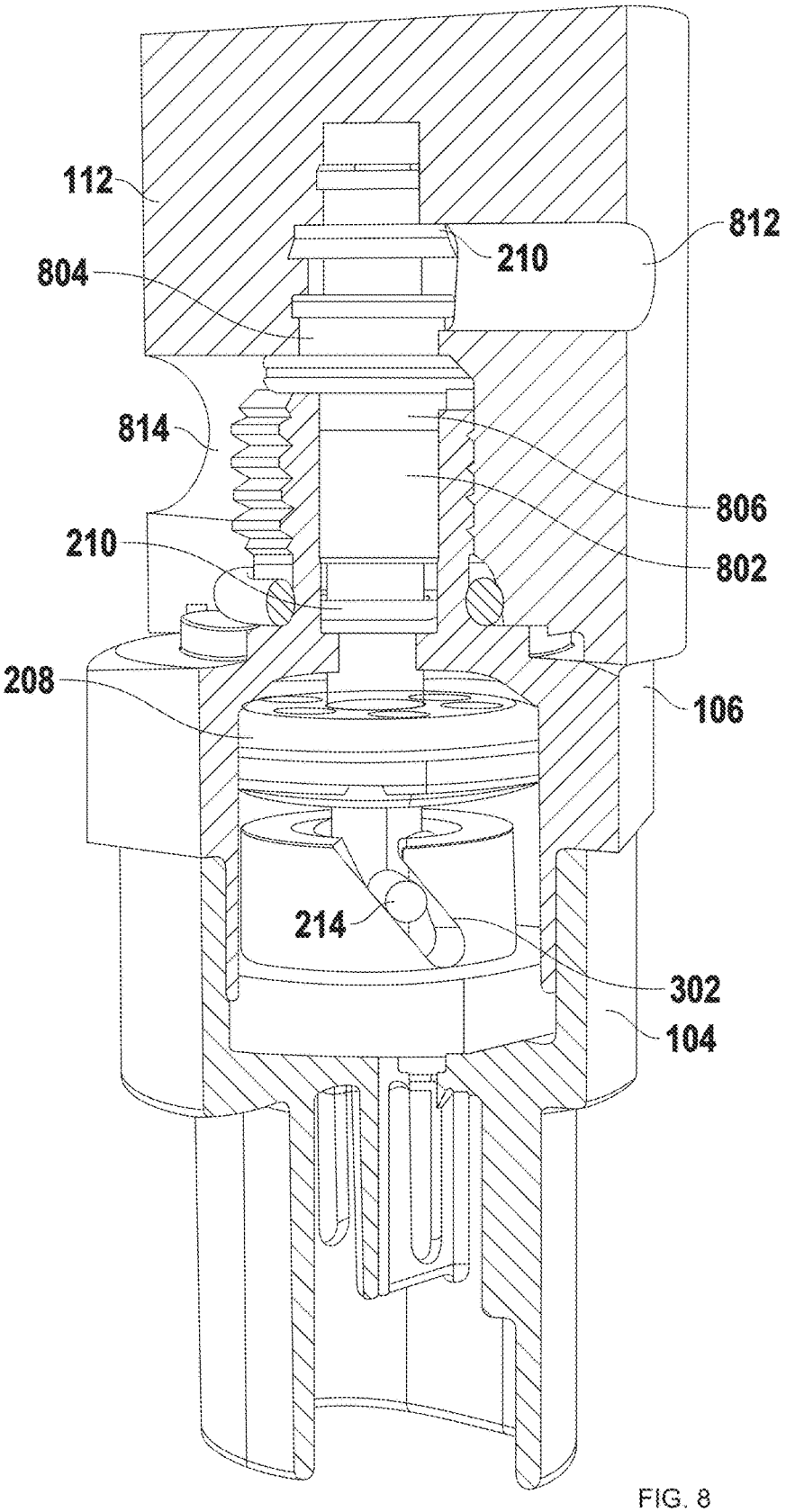
FIG. 8 shows a configuration of the switch that senses a pressure differential between a first pressure and a second pressure according to an embodiment of the invention.

FIG. 8 shows a configuration of the switch 100 that can be actuated in response to a pressure differential between a first region 804 of the piston 802 and a second region 806 of the piston 802 according to an embodiment of the invention. The fluid pressure system 102 can include at least one fluid at one or more pressure levels. In some examples, the pressure levels include two different positive pressures. In some examples, one of the pressure levels may be negative (e.g. vacuum) and the other positive. In some example, the pressure levels include two different negative pressures. The manifold 112 can include one or more ports, such as a first port 812 containing a fluid at a first pressure and a second port 814 containing a fluid at a second pressure.

The switch 100 can include a differential piston 802. The differential piston can include a piston can include more than one surface exposed to the fluid system pressure. In an example, the differential piston can include a first region 804 and a second region 806. The first region 804 can be at a first end of the piston 802. The first region 804 can be exposed through a first pressure, such as a first fluid system pressure or atmospheric pressure. The second region 806 can be exposed to a second pressure, such as a second fluid system pressure or atmospheric pressure. The first region 804 can have an equal surface area as the second region 806, or the first region 804 can have a different surface area than the second region 806. At least one u-seal 210 can be positioned on either side of piston 802. Use of a u-seal 210 can prevent the transmission of fluid pressure between the differential piston 802 and the housing 106.

The pressure differential between the first region 804 and the second region 806 can displace the piston, such as to displace the spring plate 208, cause the shorting member 214 to translate and rotate with respect to the one or more terminals, similar to examples shown above, as guided by the receptacle flutes 302, and actuate the switch 100 in response to the shorting member 214 making contact with the one or more terminals.

Figure 9:
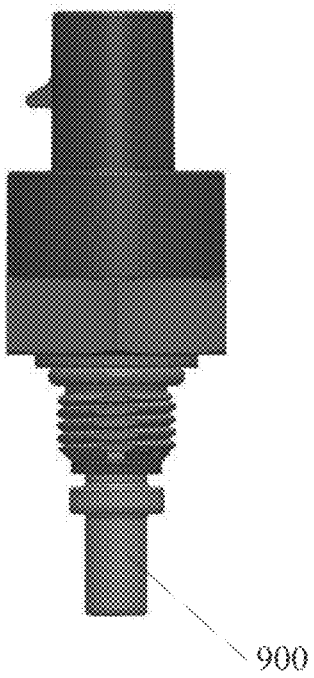
FIG. 9 shows a configuration of the switch used in conjunction with a wax motor according to an embodiment of the invention.

FIG. 9 shows a configuration of the switch 100 used in conjunction with a wax motor according to an embodiment of the invention. In an example, the switch 100 can include a wax motor 900, such as an apparatus that is extensible in response to a variation in the temperature of the apparatus. The wax motor 900 can be coupled to the piston 212. The switch 100 can be actuated in response to a temperature variation, such as when an increase or decrease in temperature alters the length of the wax motor 900 resulting in a displacement of the piston 212. When the piston 212 is displaced, the switch 100 can be actuated. In another example, the wax motor 900 is not coupled to the piston, but rather can control a valve within the pressure port 108 or 110 that exposes the piston 212 to one or more fluid pressures within the fluid pressure system 102 as a result of a temperature change.

Figure 10:
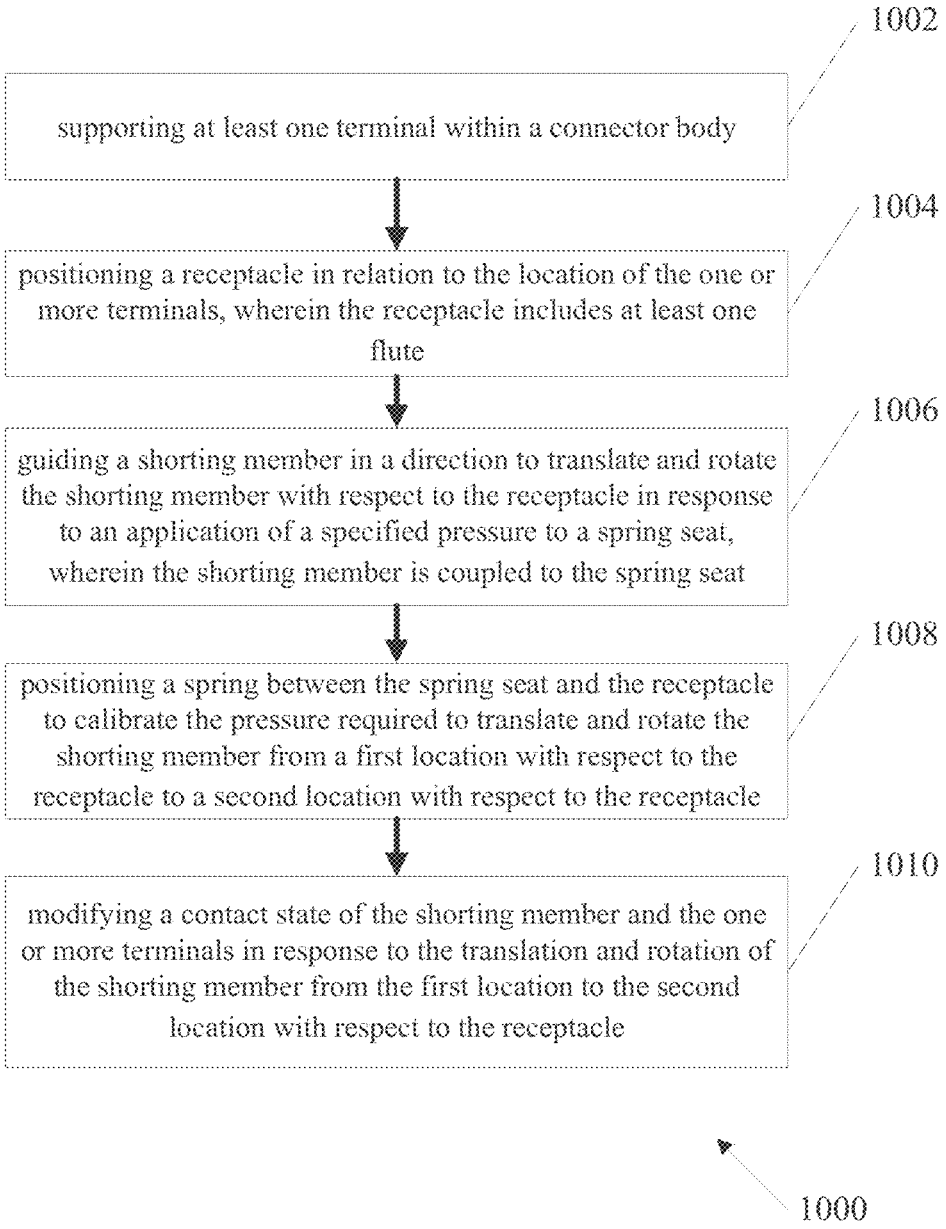
FIG. 10 shows an example method of using the switch according to an embodiment of the invention.

FIG. 10 shows an example method 1000 of using a swivel actuating pressure switch 100 according to an embodiment of the invention.

At 1002, method 1000 can include supporting at least one terminal 204 within a connector body 104. The one or more terminals 204 can be supported within the connector body 104 by various means, such as press-fitting or insert molding the one or more terminals 204 into the connector body 104.

At 1004, a receptacle 202 can be positioned in relation to the location of the one or more terminals 204. The receptacle 202 can be positioned such that the one or more terminals 204 extend through one or more passages 312 within the receptacle 202. The receptacle 202 can be rotated about its center axis, such as to modify the location of the receptacle flutes 302 with respect to the one or more terminals. In some examples, the receptacle 202 can be rotated, such as to configure the switch 100 to operate in a normally open configuration or a normally closed configuration. The receptacle 202 can be rotated to modify the pressure required to actuate the switch 100.

At 1006, a shorting member 214 can be guided, by the receptacle flutes 302, in a direction to translate and rotate the shorting member 214 with respect to the receptacle 202 in response to an application of a specified pressure to a spring plate 208, wherein the shorting member 214 is coupled to the spring plate 208.

At 1008, a spring 206 can be positioned between the spring plate 208 and the receptacle 202 in order to calibrate the pressure required to translate and rotate the shorting member 214 from a first location 802 with respect to the receptacle 202 to a second location 804 with respect to the receptacle 202.

At 1010, a contact state between the shorting member 214 and the one or more terminals 204 can be modified in response to the translation and rotation of the shorting member 214 from the first location 402 to the second location 404 with respect to the receptacle 202.

Figure 11:
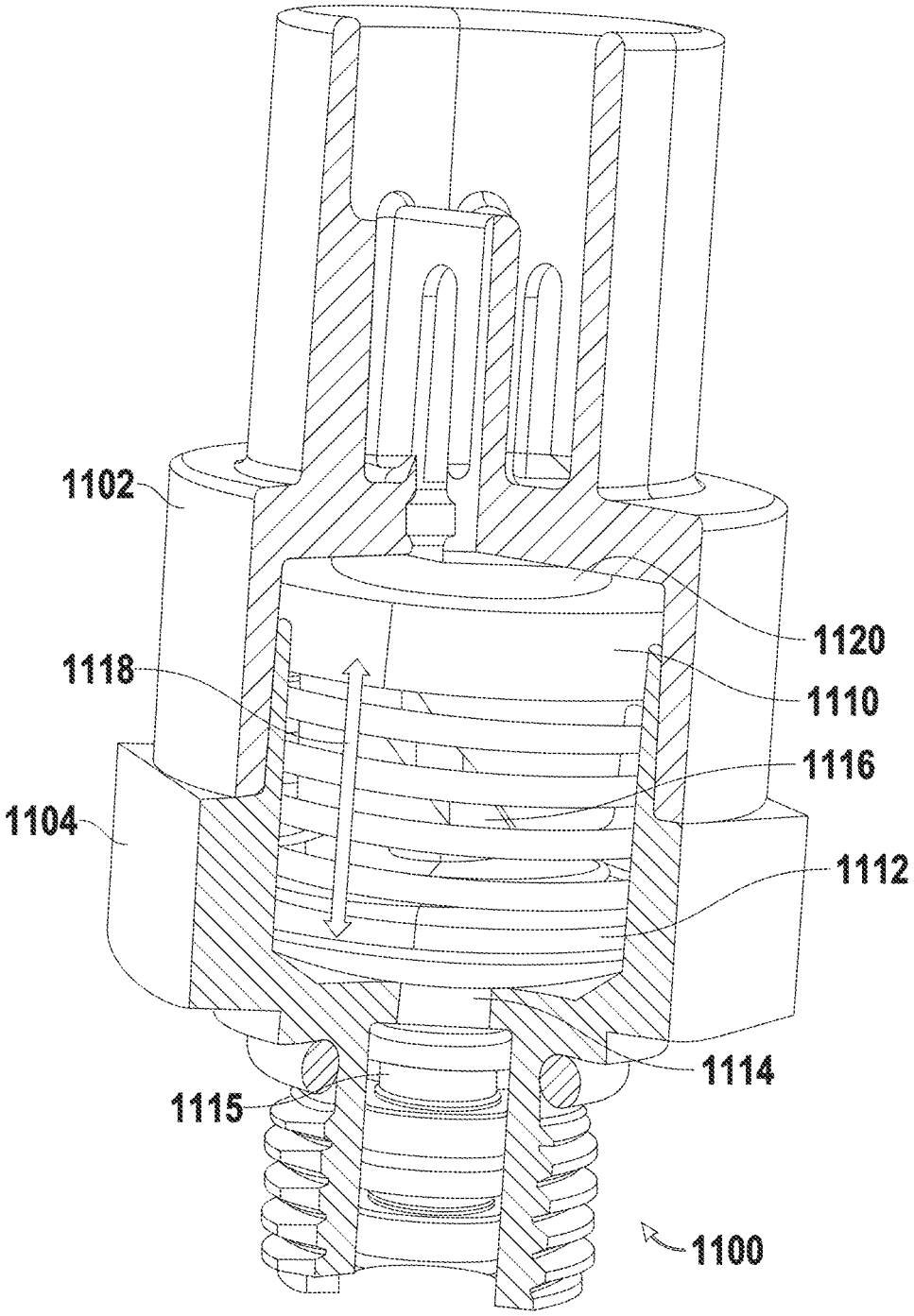
FIG. 11 shows a configuration of a switch that includes an over pressure device according to an embodiment of the invention.

FIG. 11 shows an example switch 1100 similar to switches shown in other examples discussed above. The switch 1100 of FIG. 11 includes a receptacle 1110 with flutes, a spring seat 1112, and a piston 1114 similar to examples shown in other Figures. A shorting member 1116 is shown engaged in the flutes as in other examples. In one method of operation the above listed components (receptacle 1110, spring seat 1112, and piston 1114) are all free to move to some extent along the direction 1118 within connector body 1102. In some circumstances, such as an unforeseen overpressure condition, the shorting member 1116 may be forced into the terminals with a larger than normal pressure.

In the example of FIG. 11, a resilient overpressure element 1120 is included between the receptacle 1110 and an adjacent portion of the connector body 1102. In such an application, the resilient overpressure element 1120 functions to limit motion of components such as the shorting member 1116 such that the shorting member 1116, the terminals, and other related components will not be damaged if excessive pressure conditions exist.

In one example, the resilient overpressure element 1120 includes an o-ring. The resilient nature of the resilient overpressure element 1120 functions to allow linear motion of selected elements such as the receptacle 1110, spring seat 1112, and piston 1114 when the sorting member 1116 is in contact with the terminals. By allowing a limited amount of linear motion, the possibility of damage to components in an overpressure condition is reduced or eliminated. An appropriate thickness of o-ring, and an appropriate modulus is chosen to provide solid contact, while not allowing excess force that may cause damage. Additionally, in an over pressure condition, the piston 1114 is designed with a shoulder 1115 that bottoms out against the housing 1104 and prevents any possible damage that may result if the piston 1114 were allowed to move unchecked into the housing 1104 and against related components.

Although an o-ring is shown as an example of a resilient overpressure element 1120, the invention is not so limited. Other examples may include a coil spring, a flat section rubber ring, a leaf spring, or other biasing device that functions in the same manner.

While a number of embodiments of the invention are described, the above examples are not intended to be exhaustive. Although specific embodiments have been illustrated and described herein, it will be appreciated by those of ordinary skill in the art that any arrangement that is calculated to achieve the same purpose may be substituted for the specific embodiment shown. This application is intended to cover any adaptations or variations of the present invention. It is to be understood that the above description is intended to be illustrative and not restrictive. Combinations of the above embodiments, and other embodiments, will be apparent to those of skill in the art upon studying the above description.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

To better illustrate the method and apparatuses disclosed herein, a non-limiting list of embodiments is provided here:

Example 1 includes a swivel actuating pressure switch comprising a connector body including at least one terminal supported therein, a spring seat coupled to a shorting member, a receptacle for guiding the shorting member in a direction to translate and rotate the shorting member with respect to the receptacle, and a spring coupled to the spring seat and receptacle, wherein the spring provides a reaction force such that a specified pressure applied to the spring seat will translate and rotate the shorting member from a first location to a second location with respect to the one or more terminals.

Example 2 includes the swivel actuating pressure switch of example 1, further comprising a piston and a housing, wherein the specified pressure is applied to the spring seat by way of the piston and at least one seal is positioned between the piston and the housing.

Example 3 includes the swivel actuating pressure switch of any one of examples 1-2, wherein the switch components can be interchangeably arranged using the same components such that the switch operates in a normally open or normally closed condition.

Example 4 includes the swivel actuating pressure switch of any one of examples 1-3, wherein the pressure required to translate and rotate the shorting member from the first location to the second location is configurable by rotating the connector body with respect to the receptacle.

Example 5 includes the swivel actuating pressure switch of any one of examples 1-4, wherein the pressure required to translate and rotate the shorting member from the first location to the second location occurs as a result of a pressure differential between two or more pressure ports.

Example 6 includes the swivel actuating pressure switch of any one of examples 1-5, further including a resilient overpressure element to absorb an amount of pressure on the shorting member in an overpressure condition.

Example 7 includes the swivel actuating pressure switch of any one of examples 1-6, wherein the piston includes two seals between the piston and the housing that seal two different diameters on the piston.

Example 8 includes the swivel actuating pressure switch of any one of examples 1-2, wherein the shorting member, spring seat, and piston are integrated into a single component.

Example 9 includes a swivel actuating pressure switch for use in fluid systems comprising a connector body including at least one terminal supported therein and a connector interface, a spring seat coupled to a shorting member support and a shorting member coupled to the shorting member support, a receptacle for guiding the shorting member in a direction to translate and rotate the shorting member with respect to the receptacle, a piston coupled to the spring seat, wherein the shorting member is positioned in a first location with respect to the one or more terminals and in response to the application of a specified pressure to the piston, the shorting member is translated and rotated to a second location with respect to the one or more terminals, a spring coupled to the spring seat and the receptacle, wherein the spring provides a reaction force necessary to translate and rotate the shorting member from the first location to the second location in response to the specified pressure, a housing including an outer surface extending between a first-housing-end and a second-housing-end and a passage extending axially therethrough, wherein the first-housing-end includes a means of fastening and sealing to a manifold, and at least one u-seal positioned between the piston and the housing.

Example 10 includes the swivel actuating pressure switch of example 9, wherein the pressure required to translate and rotate the shorting member from the first location to the second location is configurable by rotating the connector body with respect to the receptacle.

Example 11 includes the swivel actuating pressure switch of any one of examples 9-10, wherein the pressure required to translate and rotate the shorting member from the first location to the second location occurs as a result of a pressure differential between two or more pressure ports.

Example 12 includes the swivel actuating pressure switch of any one of examples 9-11, wherein the switch components can be interchangeably arranged using the same components such that the switch operates in a normally open or normally closed condition.

Example 13 includes a method of using a swivel actuating pressure switch comprising, supporting at least one terminal within a connector body, positioning a receptacle in relation to the location of the one or more terminals, wherein the receptacle includes at least one flute, guiding a shorting member in a direction to translate and rotate the shorting member with respect to the receptacle in response to an application of a specified pressure to a spring seat, wherein the shorting member is coupled to the spring seat, positioning a spring between the spring seat and the receptacle to calibrate the pressure required to translate and rotate the shorting member from a first location with respect to the receptacle to a second location with respect to the receptacle, and modifying a contact state of the shorting member and the one or more terminals in response to the translation and rotation of the shorting member from the first location to the second location with respect to the receptacle.

Example 14 includes the method of example 13, wherein the pressure originates from an internal combustion engine.

Example 15 includes the method of example 13, wherein the pressure originates from a pneumatic system.

Example 16 includes the method of example 13, wherein the pressure originates from a hydraulic system.

Example 17 includes the method of any one of examples 13-16, wherein the pressure for modifying the contact state of the switch is configurable while the switch is in operation by rotating the connector body with respect to the receptacle.

Example 18 includes the method of any one of examples 13-17, wherein the pressure for modifying the contact state of the switch is a differential pressure between two or more pressure ports.

Example 19 includes the method of any one of examples 13-18, wherein the switch components can be interchangeably arranged such that the switch operates in a normally open or normally closed condition.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A swivel actuating pressure switch comprising:

a connector body including one or more terminals supported therein;

a spring seat coupled to a shorting member;

a receptacle for guiding the shorting member in a direction to translate and rotate the shorting member with respect to the receptacle;

a spring coupled to the spring seat and receptacle, wherein the spring provides a reaction force such that a specified pressure applied to the spring seat will translate and rotate the shorting member from a first location to a second location with respect to the one or more terminals, wherein at some location during translation and rotation, the shorting member electrically contacts the one or more terminals; and a piston and a housing, wherein the specified pressure is applied to the spring seat by way of the piston and at least one seal is positioned between the piston and the housing.

2. The swivel actuating pressure switch of claim 1, wherein the switch components can be interchangeably arranged using the same components such that the switch operates in a normally open or normally closed condition.

3. The swivel actuating pressure switch of claim 1, wherein the pressure required to translate and rotate the shorting member from the first location to the second location is configurable by rotating the connector body with respect to the receptacle.

4. The swivel actuating pressure switch of claim 1, wherein the pressure required to translate and rotate the shorting member from the first location to the second location occurs as a result of a pressure differential between two or more pressure ports.

5. The swivel actuating pressure switch of claim 1, further including a resilient overpressure element to absorb an amount of pressure on the shorting member in an overpressure condition.

6. The swivel actuating pressure switch of claim 1, wherein the piston includes two seals between the piston and the housing that seal two different diameters on the piston.

7. The swivel actuating pressure switch of claim 1, wherein the shorting member, spring seat, and piston are integrated into a single component.

8. A swivel actuating pressure switch for use in fluid systems comprising:

a connector body including at least one or more terminals supported therein and a connector interface;

a spring seat coupled to a shorting member support and a shorting member coupled to the shorting member support;

a receptacle for guiding the shorting member in a direction to translate and rotate the shorting member with respect to the receptacle:

a piston coupled to the spring seat, wherein the shorting member is positioned in a first location with respect to the one or more terminals and in response to the application of a specified pressure to the piston, the shorting member is translated and rotated to a second location with respect to the one or more terminals;

a spring coupled to the spring seat and the receptacle, wherein the spring provides a reaction force necessary to translate and rotate the shorting member from the first location to the second location in response to the specified pressure;

a housing including an outer surface extending between a first-housing-end and a second-housing-end and a passage extending axially therethrough, wherein the first-housing-end includes a means of fastening and sealing to a manifold; and at least one u-seal positioned between the piston and the housing.

9. The swivel actuating pressure switch of claim 8, wherein the pressure required to translate and rotate the shorting member from the first location to the second location is configurable by rotating the connector body with respect to the receptacle.

10. The swivel actuating pressure switch of claim 8, wherein the pressure required to translate and rotate the shorting member from the first location to the second location occurs as a result of a pressure differential between two or more pressure ports.

11. The swivel actuating pressure switch of claim 8, wherein the switch components can be interchangeably arranged using the same components such that the switch operates in a normally open or normally closed condition.

12. A method of using a swivel actuating pressure switch comprising:

supporting at least one or more terminals within a connector body;

positioning a receptacle in relation to the location of the one or more terminals, wherein the receptacle includes at least one flute;

guiding a shorting member in a direction to translate and rotate the shorting member with respect to the receptacle in response to an application of a specified pressure to a spring seat, wherein the shorting member is coupled to the spring seat;

positioning a spring between the spring seat and the receptacle to calibrate the pressure required to translate and rotate the shorting member from a first location with respect to the receptacle to a second location with respect to the receptacle; and modifying a contact state of the shorting member and the one or more terminals in response to the translation and rotation of the shorting member from the first location to the second location with respect to the receptacle, wherein the pressure for modifying the contact state of the switch is configurable while the switch is in operation by rotating the connector body with respect to the receptacle.

13. The method of using a swivel actuating pressure switch of claim 12, wherein the pressure originates from an internal combustion engine.

14. The method of using a swivel actuating pressure switch of claim 12, wherein the pressure originates from a pneumatic system.

15. The method of using a swivel actuating pressure switch of claim 12, wherein the pressure originates from a hydraulic system.

16. The method of using a swivel actuating pressure switch of claim 12, wherein the pressure for modifying the contact state of the switch is a differential pressure between two or more pressure ports.

17. The method of using a swivel actuating pressure switch of claim 12, wherein the switch components can be interchangeably arranged such that the switch operates in a normally open or normally closed condition.

* * * * *